United States Patent [19]

Ashbrook

[11] 4,261,521

[45] Apr. 14, 1981

[54] METHOD AND APPARATUS FOR REDUCING MOLECULAR AGGLOMERATE SIZES IN FLUIDS

[76] Inventor: Clifford L. Ashbrook, P.O. Box 13237, San Antonio, Tex. 78213

[21] Appl. No.: 126,345

[22] Filed: Mar. 13, 1980

[51] Int. Cl.[3] ..... B02C 19/06

[52] U.S. Cl. ..... 241/5; 241/39

[58] Field of Search ..... 99/276; 366/173, 177; 241/5, 39

[56] References Cited

U.S. PATENT DOCUMENTS

| | | | |
|---|---|---|---|
| 238,044 | 2/1881 | Luckenbach et al. | 241/5 |
| 2,821,346 | 1/1958 | Fisher | 241/39 |

*Primary Examiner*—Mark Rosenbaum

*Attorney, Agent, or Firm*—Cox & Smith Incorporated

[57] ABSTRACT

A method and apparatus for reducing molecular agglomerate size in fluids including flowing fluid streams through opposed vortex nozzles so that the fluid streams collide and enter each other so that the kinetic forces of the streams react against each other to provide a shear action sufficient to reduce the molecular agglomerate sizes of the fluid.

6 Claims, 3 Drawing Figures

METHOD AND APPARATUS FOR REDUCING MOLECULAR AGGLOMERATE SIZES IN FLUIDS

BACKGROUND OF THE INVENTION

This invention pertains generally to reducing the size of molecular agglomerates of solids in liquids, liquids in liquids, liquids in gas and solids in gas. More particularly, it relates to a colloid mill for reducing the particle size of molecular agglomerates in fluids.

It is known that it is desirable to reduce the particle size of certain materials to enhance their properties. In particular, the pigments in paint which typically may be titanium dioxide or ferric oxide perferably are of small particle size so as to increase the surface area of the pigment in solution. The carbon black molecular agglomerate size may also be reduced to increase its surface area so that for instance it may be added to a liquid fuel and will stay in suspension as a colloid. One purpose of the addition of the carbon black to a fuel is that it adds energy to the fuel.

One method of reducing the particle size or molecular agglomerate size in solids is the use of a ball mill. Such a device can be used to reduce the particle size to obtain the desired characteristics.

Water is believed to comprise conglomerates of water molecules weakly bonded together. A theory by Pauling is that liquid water is a self-clathrate having a network of joined polyhedral cages formed of H-bonded waters and containing within their cavities entrapped, but unbound, water molecules. Another theory by Frank and Wen is that liquid water can be pictured as a mixture of "Flickering clusters" of H-bonded water molecules swimming in more or less "free" water. Although the true structure of water is not fully known, subjecting the water to the particle reducing method of the invention does change its characteristics. It has been found it lowers the pH by apparently increasing the number of free molecules or groups of molecules. Reducing the cluster size (increasing the number of free molecules) also apparently enables the water to pass through cell membranes which would otherwise restrict the flow of larger size water clusters. In particular, the molecular agglomerate of water can be reduced to such a small size that it will start removing the pigment from a section of washed red beet instantly. If the same size beet segment is submerged in tap water, removal of the red pigment takes approximately two hours and the removal takes three to four days when submerged in saline solution.

In water which has the molecular agglomerate size reduced, there is a reaction when the water contacts concrete. A white film is formed which is apparently lime which has been leached out.

It is believed that the increase in number of free molecules by reducing the number and size of clusters is beneficial to cell growth. A free water molecule can more easily pass through the openings or pores in cell membranes and plasma membranes. During the maturation process it is believed that the openings or pores in the membranes reduce in size thus reducing permeability of the water. If a cell is nourished by protein, a molecular agglomerate of protein may be encapsulated by an agglomerate of water molecules, and this form generally will pass through the openings of the cells plasma membrane (dialysis). If, however, the water molecule agglomerate encapsulating the protein is too large to pass through the plasma membrane, the cell may not receive sufficient nourishment and when it reproduces itself, an inferior cell may be produced, thereby contributing to the maturation process.

It is an object of the present invention to provide a method and apparatus to reduce the particle size of solids, liquids and gases. This is accomplished in the preferred embodiment with an apparatus which includes no moving parts and which uses the flow of the material through the apparatus to reduce the particle size thereof. Other objects of the invention will become apparent from the following detailed description of a preferred embodiment.

BRIEF DESCRIPTION OF THE PREFERRED EMBODIMENT

Figure 1:
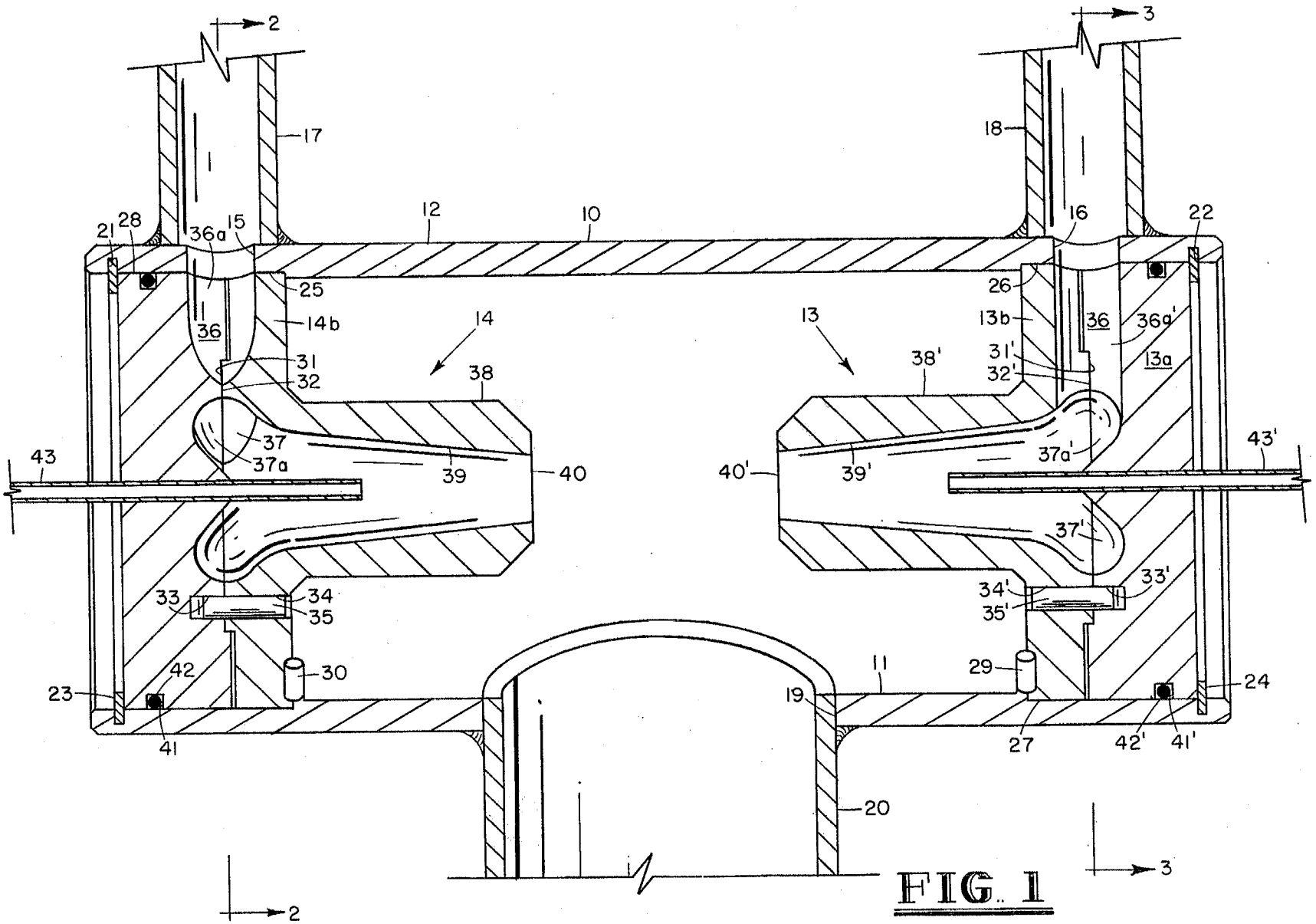
FIG. 1 is a side view and cross section of the apparatus of the invention.

Referring to FIG. 1 of the drawings, there is shown an apparatus which will reduce the size of molecular agglomerates. The apparatus can be used to form a colloid suspension such as carbon black in diesel fuel, parafin in water, which may take the form of carbon paper ink, as well as reduce the particle size of pigments in paint. It may also be used to reduce the size of agglomerates of water molecules.

The apparatus includes an enclosure having a generally cylindrical body portion 10 defined by interior cylindrical wall surface 11 and exterior cylindrical wall surface 12. Vortex tubes 13 and 14 are sealingly mounted in each end of the cylindrical body 10 as more fully explained hereinafter. The cylindrical body portion 10 includes two apertures or openings 15 and 16 extending through the cylindrical wall. Inlet conduits 17 and 18 are affixed to the outer cylindrical wall surface 12 in communication with the aperture 15 and 16 respectively by suitable means such as welding. Another opening or aperture 19 is provided in the wall of the cylindrical body portion 10 for receiving an outlet conduit 20 which is secured thereto by suitable means such as welding. The outlet conduit is positioned to receive fluid from vortex nozzles 13 and 14. Cylindrical grooves 21 and 22 are formed in the inner cylindrical wall surface 11 for receiving removable truarc rings 23 and 24 respectively. The cylindrical body portion 10 has reduced wall thickness portions 25 and 26 at each end thereof.

Positioned at each end of the cylindrical body portion 10 are vortex nozzles 13 and 14. The outer surfaces 27 and 28 of the vortex nozzles 13 and 14 are of slightly less diameter than the diameter of the reduced wall thickness portions 25 and 26 so that the vortex tubes may be fitted within the cylindrical body portion 10. Dowel pins 29 and 30 are provided to align the vortex nozzles and properly position them when they are inserted within the cylindrical portion 10.

Each vortex nozzle 13 and 14 is similar in construction, the primary difference being the direction of rotation imparted to fluid passing therethrough. The reference numerals for the nozzle 13 are the same for comparable components of nozzle 14 with the addition of a prime (') superscript.

The vortex nozzle 14 includes a first body portion 14*a* and a second body portion 14*b*. The body portions 14*a* and 14*b* include mating surfaces 31 and 32 which engage. An aperture or opening 33 is provided in the first body portion 14*a* and an aligned aperature or opening 34 is provided in the second body portion 14*b* for receiving a dowel pin 35 to align the body portions in their proper configuration.

Figure 2:
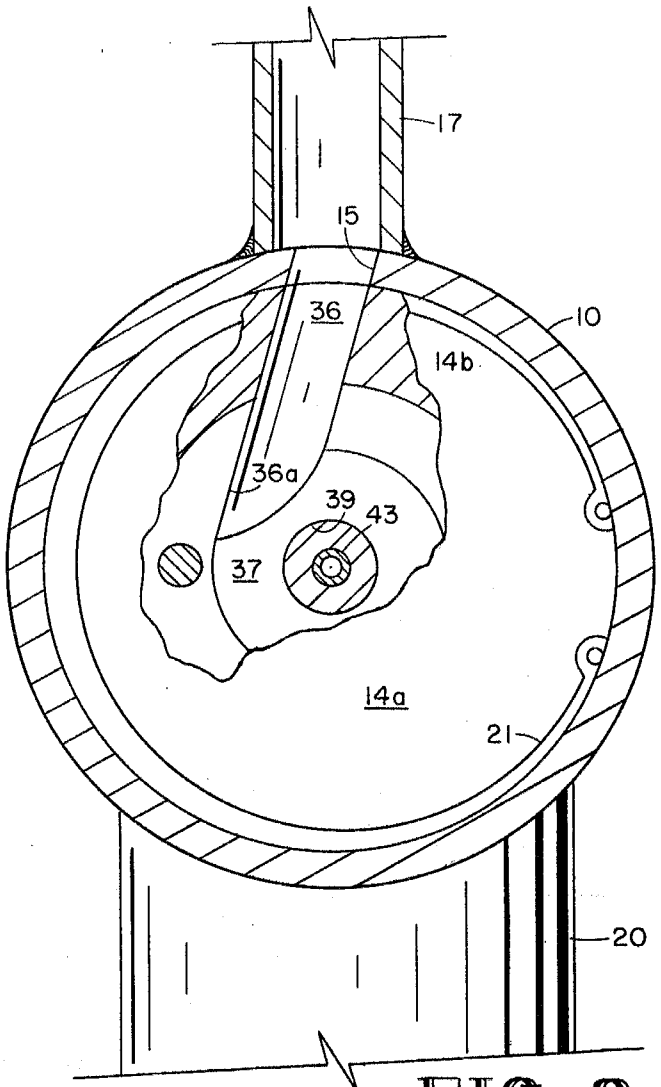
FIG. 2 is a cross-sectional view taken along line 2—2 in FIG. 1.

As shown in FIGS. 1 and 2, the vortex tube 14 includes a cylindrical passageway 36 defined by surface 36*a* which extends to a receiving section 37 which receives material flowing through the passageway defined by surface 36*a*. A material flowing through the passageway 36 formed by surface 36*a*, will enter the receiving section 37, defined by cylindrical surface 37*a* having a generally circular cross section to create a whirling or rotating pressurized mass of material. The material will exit the vortex tube 14 through a nozzle portion 38 having an inner surface 39, circular in cross section, and an outlet 40. As will be apparent, the inner surface 39 decreases in diameter from left to right in FIG. 1. A cylindrical slot 41 is provided in the first body portion 14*a* for receiving a O-ring 42 to provide a seal between the outer surface 28 and the inner surface of the reduced wall portion 25. As will be apparent, the truarc ring 23 retains the vortex nozzle 14 in position. A vortex inlet quill 43 is provided for injecting materials into the nozzle such as pigment or carbon black.

Fluid or material entering the passageway 36 and flowing into the receiving section 37 is given a counterclockwise rotation as viewed from FIG. 2, which it retains as it exits the nozzle outlet 40. The principle of operation of vortex nozzles or separators is well known as shown in applicant's Pat. No. 3,529,405 as well as in U.S. Pat. Nos. 2,757,581; 2,757,582; 2,816,490; 2,849,930; 3,007,542; 3,956,294; 3,064,721; 3,331,193; 3,442,065; 3,800,946; and 3,807,142.

The vortex nozzle 13 includes a first body portion 13*a* and a second body portion 13*b*. The body portions 13*a* and 13*b* include mating surfaces 31' and 32' which engage. An aperture or opening 33' is provided in the first body portion 13*a* and aligned aperture or opening 34' is provided in the second body portion 13*b* for receiving a dowel pin 35' to align the body portions in their proper configuration.

Figure 3:
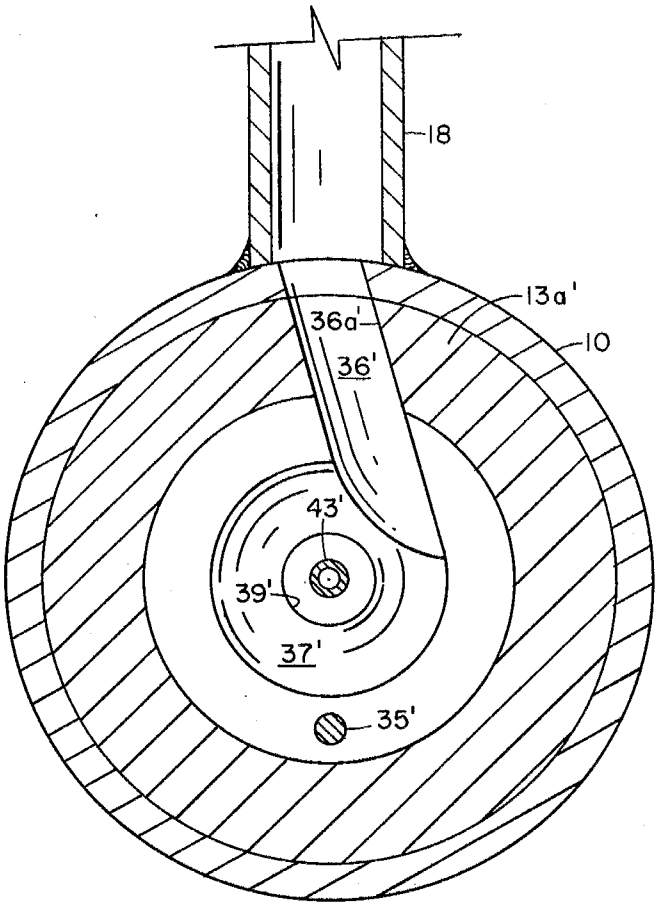
FIG. 3 is a cross-sectional view taken along line 3—3 in FIG. 1.

As best shown in FIGS. 1 and 3, the vortex tube 13 includes a cylindrical passageway 36' defined by surface 36*a* which extends to a receiving section 37' which receives material flowing through the passageway defined by the surface 36*a'*. A material flowing through the passageway 36' formed by surface 36*a'* will enter the receiving section 37' defined by cylindrical surface 37*a'* having a generally circular cross-section to create a whirling or rotating pressurized mass of material. The material will exit the vortex tube 13 through a nozzle portion 38' having an inner surface 39', circular in cross section, and an outlet 40'. As will be apparent, the inner surface 39' decreases in diameter from right to left in FIG. 1. A cylindrical slot 41' is provided in the first body portion 13*a* for receiving an O-ring 42' to provide a seal between the outer surface 27 and the inner surface to reduce wall pressure 26. As will be apparent, the truarc ring 24 retains vortex nozzle 13 in position. A vortex inlet quill 43' is provided for injecting materials into the nozzle such as pigment or carbon black. The distance between the nozzle exit varies directly with the specific gravity of the fluid. The lighter the fluid, the shorter the distance.

Fluid or material entering the passageway 36' and flowing into the receiving section 37' is given a clockwise rotation as viewed from FIG. 3 which it retains as it exits the nozzle outlet 40'.

The streams which exit the nozzles 40 and 40' are rotating in the opposite direction when they collide approximately halfway between the nozzle outlets 40 and 40' to create a shear action. The materials exiting the nozzles 40 and 40' collide with each other which provides a milling-like action to reduce the size of molecular agglomerates. It is not fully understood what occurs at the innerface of the colliding materials exiting the nozzles 40 and 40'. However, material exiting the outlet conduit 20 has a smaller particle size as desired. The streams exiting the nozzles have substantially the same velocity so that when they collide, the kinetic forces are much greater than when a stream engages a stationary plate. This can be likened to two trains traveling at the same speed colliding as opposed to one train striking a stationary object.

The streams have sufficient velocity and energy which causes them to enter each other upon colliding. They are also rotating in opposite directions as they enter each other to provide the shearing or milling-like action. The interaction of the fluid streams also enable them to transfer their energy to each other to help reduce the agglomerate size. This type of interaction is believed to be superior to merely directing a stream at a stationery object which would absorb some of the energy of the stream.

The enclosure is sized to contain the fluid of the streams exiting the nozzles and channel the fluid to the outlet conduit 20. The outlet conduit 20 is positioned in proximity to the location where the streams collide so that the fluid will not fill the housing and interfere with the force of the streams exiting the nozzles. The shape and size of the enclosure also provide that fluid deflected off the interior surface thereof does not interfere with the force of the streams. The exit velocity of the outlet conduit 20 is preferably much less than the velocity of the streams exiting the nozzles, so there is little or no back pressure to interfere with the colliding streams.

The enclosure may be insulated with foil and fiberglass or foam insulation to prevent heat loss, which heat is generated by the large kinetic energy of the high pressure streams. In this connection, the size and shape of the enclosure and positioning of the nozzles help retain this kinetic energy so that it will provide maximum reduction in size of molecular agglomerates.

The temperature of water exiting is generally steady when it is measured by a thermocouple. But for some reason, it may vary as much as 20 degrees F for a short period. The water is being constantly recirculated so it may be storing up energy. Also, this may occur at a certain agglomerate size as the agglomerates are broken down. The thermocouple measures in milliamps, so electron release is being calculated as particles break off of the agglomerates.

Suitable pumps, cooling means and mixing means are provided to mix and recirculate fluid through the nozzles until the desired particle size is obtained. The amount of recirculating required depends on the material and particle size desired.

Although the invention has been described in conjunction with the foregoing specific embodiment, many alternatives, variations and modifications will be apparent to those of ordinary skill in the art. These alternatives, variations and modifications are intended to fall within the spirit and scope of the appended claims.

Another use of the method and apparatus of the invention is in the brewing of beer and making of liquor. A product of the beer brewing process is end-fermented beer which is the fluid produced at the end of the fermentation process. This contains the water, alcohol and particulate matter remaining after fermentation. It has been a practice in the past to filter particulate matter out of the endfermented beer as many as two times. Another step is the aging of the beer for several weeks. A final step before bottling has been to again filter out the particulate matter, carbonate it and flash pasteurize it.

By use of the method and process of the invention, the step of aging can be significantly reduced, if not eliminated entirely. In this connection, the end-fermented beer is run through the apparatus a predetermined amount to reduce the size of molecular agglomerates therein to a predetermined size before filtering. It is believed that the aging process would normally perform the size reduction to some degree, given sufficient time. By eliminating the need for aging, the time for making the beer is reduced. Also, there is no need to flash pasteurize the beer to increase its shelf life. The breaking down of the particle size somehow inhibits spoilage to provide a shelf-life greater than or equal to pasteurized beer.

Beer normally deteriorates rapidly after bottling and quality is affected by sunlight, shipping and time. Treatment of the end-fermented beer with the method and apparatus of the invention, in addition to shortening the brewing process, increases the resistance to damage from shipping as well as permissible time on the shelf or in storage. Again, this is believed to result from the particle size reduction. Another benefit is the blending of the beer to provide a more uniform product.

The method and apparatus of the invention can also be used with liquors or distilled spirits. The longer chain alcohol molecules or heavy ends are borken down as is also believed to occur with beer. This is believed to involve the breakdown of the N-propanols such as $CH_3.CH_2.CH_2.OH$ (1-propanol) and $CH_3.CHOH.CH_3$ (2-propanol) to ethanol ($CH_3.CH_2.OH$). There are also much longer chain alcohol molecules which are likewise believed to be involved in the particle size reduction.

The result with distilled spirits is also a more palatable product as well as a reduction in the aging process. Again, the aging process is believed to involve the particle size reduction to some degree, which can be achieved in a significantly shorter time with the invention.

I claim:

1. A method for reducing the size of molecular agglomerates in a fluid, comprising the steps of:

flowing a first stream of the fluid through a first nozzle means in an enclosure for containing and conducting fluid to an outlet for the enclosure;

flowing a second stream of the fluid through a second nozzle means in the enclosure against the first stream of fluid so that the streams enter each other and provide a shear action to the fluid sufficient to reduce the size of molecular agglomerates in the fluid;

the steps of flowing the streams of fluid through the nozzle means includes the steps of imparting rotation to the streams of fluid; and the steps of imparting rotation to the streams of fluid includes the steps of imparting opposite rotation to the streams of fluid as they are directed against each other.

2. The method as set forth in claim 1 wherein:

the steps of flowing include flowing streams of end-fermented beer.

3. The method as set forth in claim 1 wherein:

the steps of flowing include flowing streams of distilled spirits.

4. The method as set forth in claim 1, including the step of;

injecting material into the centers of the rotating streams within the nozzle means.

5. An apparatus for reducing the size of molecular agglomerates in a fluid, comprising:

an enclosure for receiving fluid and having an outlet for the fluid;

a first nozzle means for flowing a first stream of fluid within the enclosure;

a second nozzle means for flowing a second stream of fluid within the enclosure and positioned in opposed relation to the first nozzle means so that the fluid streams exiting the first and second nozzle means are directed against each other so that they enter each other and so that the kinetic forces of the streams react against each other to provide a shear action to the fluid sufficient to reduce the size of molecular agglomerates in the fluid;

the first and second nozzles means comprising opposed vortex nozzles to provide a rotation to the fluid streams exiting the nozzles;

the opposed vortex nozzles providing the same direction of rotation to each exiting fluid stream so that the fluid streams are rotating in opposite directions when they are directed against each other.

6. The apparatus as set forth in claim 5, wherein:

the nozzle means having inlet means for injecting another material into the fluid in the nozzle.

* * * * *